United States Patent [19]

Smith et al.

[11] 4,063,319

[45] Dec. 20, 1977

[54] BEDROLL FOR CONVERTIBLE BED

[76] Inventors: David L. Smith; Cary Frank, both of 345 W. Fullerton, Chicago, Ill. 60614; Mary Lupton, 505 N. Lake Shore Drive, Chicago, Ill. 60611; Stephanie Lupton, 1100 N. Dearborn, Chicago, Ill. 60610

[21] Appl. No.: 672,351

[22] Filed: Mar. 31, 1976

[51] Int. Cl.[2] ..... A47G 9/00

[52] U.S. Cl. ..... 5/334 R; 5/343

[58] Field of Search ..... 5/334 R, 334 C, 335, 5/340, 12 B; 24/208, 210

[56] References Cited

U.S. PATENT DOCUMENTS

| | | | |
|---|---|---|---|
| 582,818 | 5/1897 | Gendron | 24/208 R |
| 815,474 | 12/1898 | Brauch | 24/210 |
| 1,240,968 | 9/1917 | Hara | 5/340 |
| 1,913,750 | 6/1933 | Frank | 5/335 |
| 3,774,249 | 11/1973 | Ybarra et al. | 5/334 R |
| 3,877,092 | 4/1975 | Gaiser | 5/343 |
| 3,965,504 | 6/1974 | Ainsworth | 5/335 |

FOREIGN PATENT DOCUMENTS

| | | | |
|---|---|---|---|
| 457,584 | 3/1928 | Germany | 5/335 |

*Primary Examiner*—Paul R. Gilliam
*Assistant Examiner*—Victor N. Sakran

[57] ABSTRACT

A bedroll has an appearance of a cylindrical sofa cushion, by day. When unrolled, it forms bed clothing, with sheets and blankets or the equivalent. The bedroll has at least two separate layers, which are releasably secured together by fasteners. One layer is both a blanket and a shell or outer covering of attractive material that either matches or coordinates with the upholstery on a sofa or other furniture adapted to utilize a pillow similar to the rolled sleeping bag. The other layer is a washable sheeting which may be inserted into, used, and removed from the bedroll. When the two layers are secured together, their combined visible edge has a characteristic which enables the bedding to be rolled, without appearing to be rolled bedding.

5 Claims, 7 Drawing Figures

BEDROLL FOR CONVERTIBLE BED

This invention relates to means for and methods of storing bedding — especially for use on convertible furniture, such as a sofa, or the like, which is convertible into a bed at night.

Small apartments, family rooms, living rooms, and the like have a need for articles of furniture which are, for example, sofas or the like by day and beds by night. With such furniture, there is a problem of conveniently storing sheets, blankets and other bed clothes by day, without making them unduly inaccessible by night. There is also a problem that any bed which can be folded into a sofa, inherently must be a much smaller and lighter weight than an average bed. Thus, a folding bed tends to be less comfortable, not as durable, and otherwise less satisfactory than a conventional bed.

To avoid these and other problems, it is possible to construct a sofa as a bed is constructed with box springs and mattress. However when this happens, the sofa tends to look like a bed and to be less satisfactory as a decorative piece of furniture. Therefore, efforts are often made to design the sofa in a manner which camouflages its bed aspects. However, this still leaves the problem of what to do with the bed clothes during the day, since they tend to defeat the camouflaging efforts.

Accordingly, an object of the invention is to provide new and improved means for and method of storing bedding for convertible furniture. Here, an object is to provide bedrolls for sofas, or the like, having the comfort and durability of a convential bed and the attractive decorative design of furniture. In particular, an object is to provide convertible furniture of the type described, with means for storing bed clothes by day.

Another object of the invention is to provide attractive bedrolls which are comfortable during sleep and yet do not appear to be a bedroll when stored. Here, an object is to provide bedrolls which appear to be a sofa pillow when stored.

Another object is to provide new and improved bedrolls which have general utility, regardless of whether they are or are not used on or in connection with convertible furniture.

In keeping with an aspect of the invention, these and other objects are accomplished by a bedroll having at least two layers which are secured together by releasable fasteners. One layer includes a shell or outer covering of attractive material so that the bedding appears to be a sofa pillow when it is rolled. The other layer is washable sheeting which may be removed and laundered. When the two layers are secured together, their combined edge has a characteristic which enables the bedding to be rolled, without appearing to be rolled bedding.

The nature of a preferred embodiment of the invention is seen in the attached drawings wherein.

Figure 1:
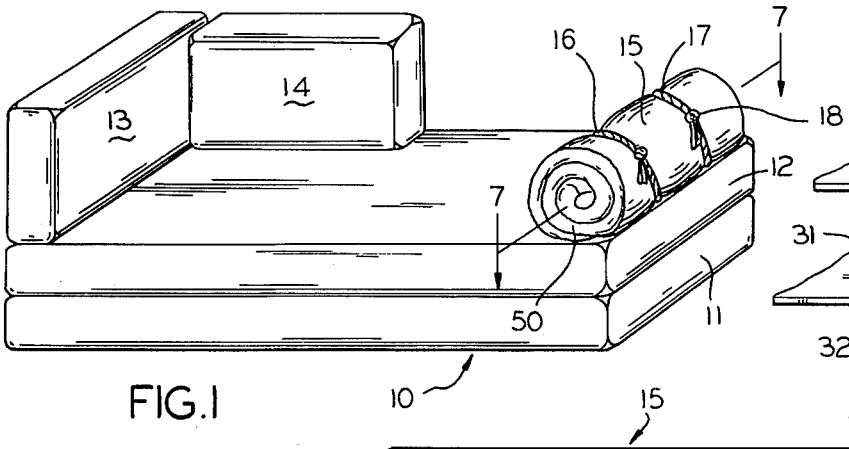
FIG. 1 is a perspective view of an exemplary sofa, by day, with the inventive bedroll thereon.
Figure 2:
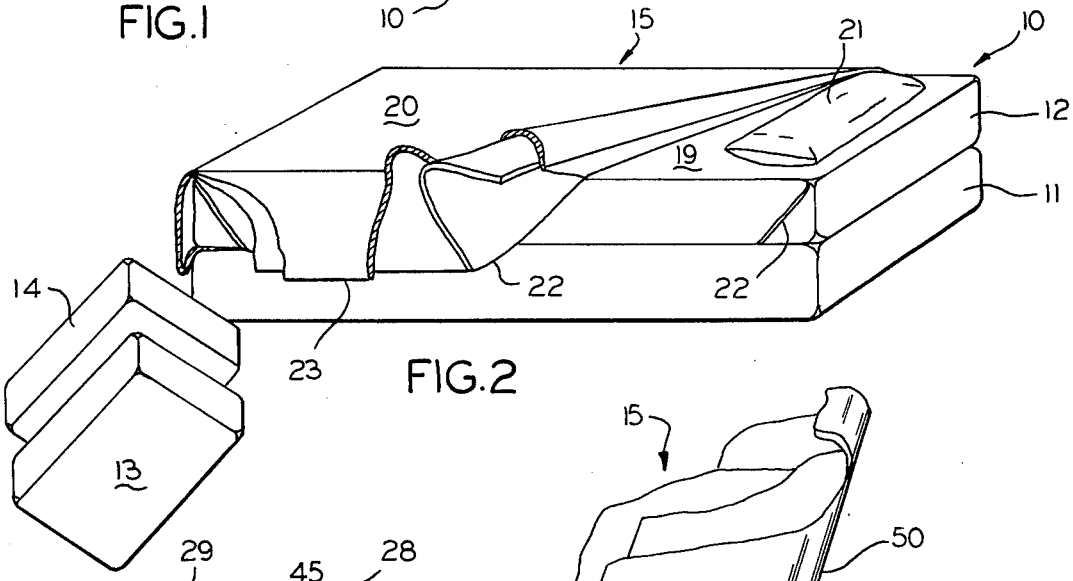
FIG. 2 is a perspective view of the same sofa, when used as a bed.

The sofa 10 of FIGS. 1, 2 comprises any suitable number of units, stacked one on the other. As here shown, there are two units 11, 12, of which unit 11 might be box springs and unit 12 might be an inner spring mattress. Any suitable number of sofa cushions may be provided to lean against a wall or end frame and thereby form a back or arm for the sofa. Each of these units or cushions may be covered by any appropriate upholstery material. Also, any suitable decorative trim may be provided to give a desired furniture style. Of course, there are many other forms of folding or convertible beds which may also use the inventive bed roll.

The inventive bed roll 15 has two layers (FIG. 3) which include an outer covering that either matches or coordinates with the upholstery used on the bed 10 or cushions 13, 14. During the day, the bedroll 15 may be rolled (FIG. 1) to have an appearance of a cylindrical sofa cushion. It is also possible to provide formers, such as four rigid panels, which may tend to give the bedroll an appearance of a generally parallelepiped cushion.

The bedroll may be held in the rolled condition by any suitable means. For example, the drawing shows ropes, cords or ties 16, 17 which may surround the rolled bedroll. These cords could also be elastic material which simply stretches and then contracts around the bedroll. Any suitable decorative material may be added, as indicated at 18, to make the roll look more like a cushion. As here shown, there is a large button 8 with tassle-like ties dependent therefrom. The tie may be slid through the button to loosen or tighten the loop around the roll.

At night, the back and arm cushions 13, 14 may be removed from sofa 10, the ties 16, 17 may be removed from the bedroll 15 and the bedding may be unrolled, shown in FIG. 2. An under side 19 of the bedroll may be tucked in around the mattress 12. An outer side 20 of the bedroll rests on, covers and drapes over the top of the bed 10 to provide a bed spread appearance, matching the furniture decor, if it becomes necessary or desirable to leave the bed configuration during the day. A separate bed pillow 21 may or may not be provided.

Figure 3:
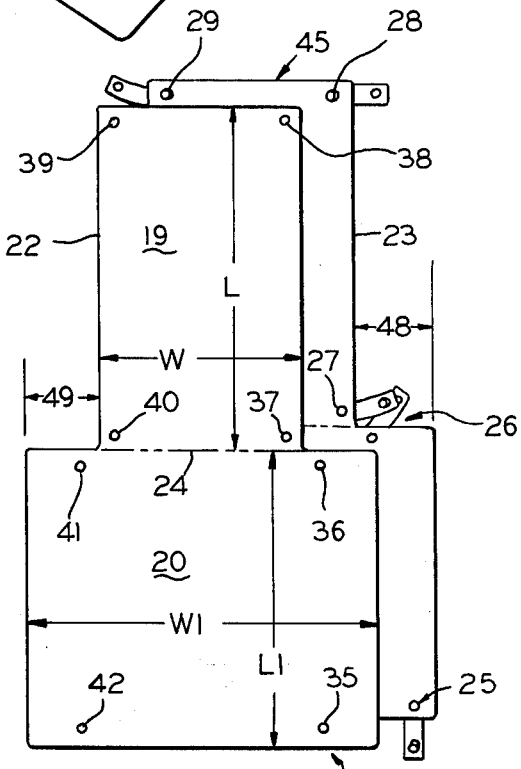
FIG. 3 is a plan view of two layers of the inventive bedding.

The nature of the inventive bedding material is seen in FIG. 3 which shows a first layer 22 of washable sheeting material and an outer covering layer 23. The sheeting 22 may be made of any material which is conventionally used for sheets and pillow cases. Preferably, the outer covering 23 includes an insulating material, such as a blanket, quilt or padded material. Of course, any number of additional layers may also be used.

Each layer 22, 23 may be viewed as having a generally T-shaped configuration. The stem of the T has a length L and a width W of dimensions which fit over and tuck-in under the mattress 12, as desired. The cross arm of the T-shape has a length L1 and a width W1, adequate to hang down to cover a peron in the bed. The two layers 22, 23 fold along a line 24 between the stem 19 and the cross arms 20 of the T.

The outer cover 23 includes a number of peripheral fasteners 25–29 for attaching it to the periphery of the sheet 22 and to any additional blankets which may be provided. Any such additional blankets may be generally rectangular, of dimensions L1, W1, without the stem pad 19 of the T-shape. Each of the fasteners 25–29 preferably comprises a post 30 (FIG. 4) and a snap 31 attached to the end of a ribbon 32. The sheet 22 (and any additional blankets) includes a number of mating holes 35–42 which fit over the posts of individually associated fasteners. (The fasteners associated with holes 40–42 are not visible in FIG. 3.)

Figure 4:
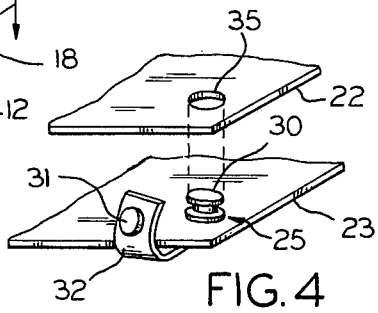
FIG. 4 is a perspective view of a fastener used to hold the two layers together.
Figure 5:
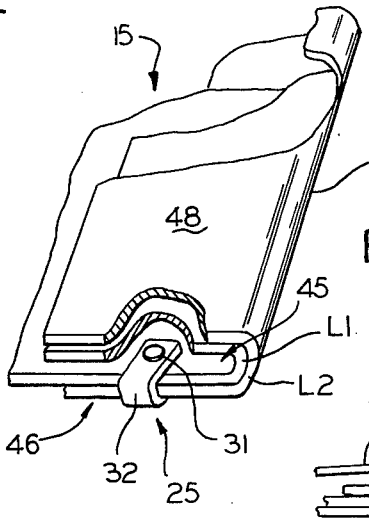
FIG. 5 is a perspective view (partly in cross-section) of an edge of the bedding of FIG. 3, showing how a combined edge is formed, to avoid the appearance of a bedroll, when the bedding is rolled.
Figure 6:
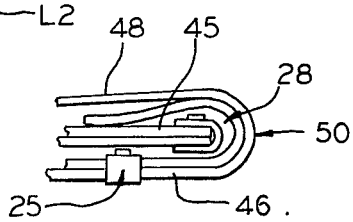
FIG. 6 is an elevation view of the lower right-hand end of the bedding of FIGS. 3, 5, after an initial folding step.
Figure 7:
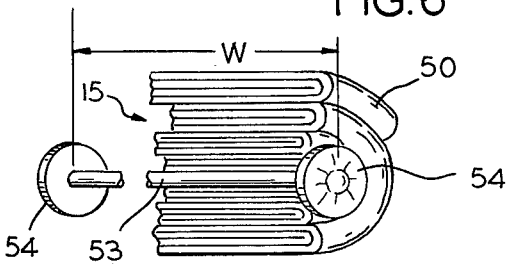
FIG. 7 is a cross-sectional view of the bed roll, taken along line 7—7 of FIG. 1.

As should be apparent from FIG. 4, the outer layer or cover 23 is laid out flat, as shown in FIG. 3. Then, the inner layer or sheet 22 is laid over the outer layer 23 with each of the holes 35–42 fitting over the corresponding, individually associated post. Thus, for example, in FIG. 4, hole 35 fits over post 30 and snap 31 is snapped over the post. The ribbon 32 folds over and holds the sheet 22 in place. Then, the entire T-shaped assembly is folded along line 24 (FIG. 3) so that the top edge 45 comes down to the bottom edge 46, as seen in the end view of FIG. 6. Next, the extended portions of cross arms 48, 49, of the T-shaped sections, are folded over (FIGS. 5, 6) in alignment with the edges of section 19. It should now be apparent that when the bedroll 15 is rolled up, only the combined edge 50 is seen. The stem section 19 of the T-shape is completely concealed from view; however, the extra body which it provides lies flat, in the middle of the combined edge fold 50. Therefore, the combined edge 50 rolls as a unit, when the bedroll is formed, to give an even and finished texture to the sprial pattern followed by the edge of the rolled bedroll (FIG. 7).

Any suitable optional device may also be provided, if desired, to further give the bedroll a finished appearance. For example, there could be a rod 53 having a length W, with a large decorative button or disc 54 on either end, to provide a spool or former. Then, the sleeping bag 15 may be rolled on the spool 53, 54 so that the opposite ends of the cylindrical roll 15 have a decorative finish that further reduces the appearance of a bedroll.

Those who are skilled in the art will readily perceive how further modifications may be made. Therefore, the appended claims are to be construed to cover all equivalent structures falling within the true scope and spirit of the invention.

We claim:

1. A bedroll having an appearance of a cylindrical sofa cushion when rolled and forming bed clothing when unrolled, said bedroll having at least two completely separate layers one of which forms insulating material with an outer covering of upholstery material and the other of which forms removable top and bottom washable sheets, a plurality of fastener means, the peripheries of said two layers being releasably secured together by said fasteners, said one of said layers forming an outer covering of upholstery material when said bedroll is rolled, whereby said cushion may either match or coordinate with upholstery on a sofa or other furniture and the other layer forming said removable washable sheeting which may be releasably attached around the entire periphery to said one layer, inserted into, used, and removed from the bedroll, the two layers having on each of the opposite ends of said bed roll a combined visible edge which includes only the upholstery material and thereby enables the bedding to be rolled, without necessarily appearing to be rolled bedding, each of said fasteners comprises a two-part fastener including a post and a snap attached to one of said layers and having a ribbon extending between the two parts, and mating means comprising a hole formed on the other of said two layers for enabling said ribbon to fold over a peripherial point on said other layer and for enabling the two parts of said fastener to be fastened together while capturing said mating means on said other layers, said hole formed in said other layer fitting over said post before said snap is snapped thereover, wherein each of said layers has a generally T-shaped configuration, said stem part of said T-shape folding over the cross arms of said T-shape and the extended portions of said cross arms folding over the extra body of said stem to give a smooth combined edge which rolls without giving the visual impression of a bedroll.

2. The bedroll of claim 1 wherein the stem of said T-shape has dimensions which fit over and tuck under a mattress for forming a bottom sheet of bedding which a person lies upon while resting on the top of the mattress and the cross arms of said T-shape have dimensions which rest on, cover, and drape over the top of said mattress and the person who is resting on said mattress.

3. The bedroll of claim 1 and a spool having decorative means at opposite ends for enabling a rolling of the bedroll around said decorative means, whereby the opposite ends of said bedroll have a decorative finish.

4. The bedroll of claim 1 wherein said sofa comprises a plurality of stacked units and an upper one of said stacked units comprises said mattress.

5. The bedroll of claim 1 wherein said sofa comprises a plurality of stacked units the upper of which is a mattress, the stem of said T-shape having dimensions for fitting over and tucking under said mattress and the cross arms of said T-shape having dimensions to rest on, cover, and drape over the top of said mattress when a person is resting on said mattress.

* * * * *

UNITED STATES PATENT AND TRADEMARK OFFICE

CERTIFICATE OF CORRECTION

PATENT NO. : 4,063,319

DATED : December 20, 1977

INVENTOR(S) : David L. Smith et al.

It is certified that error appears in the above-identified patent and that said Letters Patent are hereby corrected as shown below:

Col. 2, line 35, change "8" to --18--; col. 2, line 62, change "peron" to --person--.

Signed and Sealed this

Ninth Day of May 1978

[SEAL]

Attest:

RUTH C. MASON
Attesting Officer

LUTRELLE F. PARKER
Acting Commissioner of Patents and Trademarks